United States Patent [19]

Fushimi et al.

[11] Patent Number: 5,061,588

[45] Date of Patent: Oct. 29, 1991

[54] DRY TYPE TONER FOR ELECTROPHOTOGRAPHY

[75] Inventors: Hiroyuki Fushimi, Numazu; Nobuhiro Nakayama, Susono; Yasuo Asahina, Numazu; Mitsuo Aoki, Numazu; Kayo Makita, Numazu, all of Japan

[73] Assignees: Ricoh Company, Ltd.; Petrochemical Industries, Ltd. Mitsui, both of Tokyo, Japan

[21] Appl. No.: 338,599

[22] Filed: Apr. 14, 1989

[30] Foreign Application Priority Data

Apr. 19, 1988 [JP] Japan ..... 63-97129
Apr. 19, 1988 [JP] Japan ..... 63-97132

[51] Int. Cl.[5] ..... G03G 9/00; G03G 5/00

[52] U.S. Cl. ..... 430/109; 430/137; 430/904

[58] Field of Search ..... 430/904, 109, 137; 525/533; 428/112

[56] References Cited

U.S. PATENT DOCUMENTS

| | | | |
|---|---|---|---|
| Re. 31,022 | 8/1982 | Buchwalter et al. | 523/418 |
| 3,681,106 | 8/1972 | Burns et al. | 430/120 |
| 4,522,984 | 6/1985 | Watanabe et al. | 525/415 |
| 4,829,105 | 5/1989 | Yamada et al. | 523/415 |

FOREIGN PATENT DOCUMENTS 5093159 7/1980 Japan .

*Primary Examiner*—Marion E. McCamish
*Assistant Examiner*—S. C. Crossan
*Attorney, Agent, or Firm*—Oblon, Spivak, McClelland, Maier & Neustadt

[57] ABSTRACT

A dry type toner for electrophotography is disclosed which comprises as the main components (a) a coloring agent; and (b) a polyol resin serving as a binder agent in an effective amount, the polyol resin being prepared by subjecting a bisphenol-type epoxy resin containing epoxy groups, which may contain secondary hydroxyl groups, to reaction steps (1), (2) and (3), or steps (2) and (3), in any sequential combination, until substantially no epoxy groups remain in the polyol resin, wherein the reaction step (1) comprises a step of causing the epoxy groups in the bisphenol-type epoxy resin to react with a primary amine; the reaction step (2) comprising a step of causing the epoxy groups to react with a compound containing one active hydrogen capable of reacting with the epoxy groups; and the reaction step (3) comprising a step of esterifying at least part of the secondary hydroxyl groups or hydroxyl groups produced in the bisphenol-type epoxy resin by reaction step (1) and/or reaction step (2) by use of an esterifying agent.

17 Claims, No Drawings

DRY TYPE TONER FOR ELECTROPHOTOGRAPHY

BACKGROUND OF THE INVENTION

1. Field of the Invention

This invention relates to a dry type toner for electrophotography suitable for producing color images of high quality.

2. Discussion of Background

In a dry-type electrophotographic process, latent electrostatic images formed on a photoconductor are developed with a dry-type toner. The resulting toner images are transferred to a transfer sheet or copy paper, and thermally fixed thereto, for instance, by a thermal image fixing roller.

Dry-type toners for use in the above process comprise a binder resin and a coloring agent as the main components, and when necessary, auxiliary components such as a charge controlling agent and an off-set preventing agent are added thereto. With the necessary properties for the toners, such as transparency, insulating property, water-resistance, fluidity as powder, mechanical strength, glossiness, crushability and thermoplasticity, taken into consideration, polystyrene resin, styrene—acrylic acid copolymer, polyester resin and epoxy resin are in general use as binder resins of the dry-type toners. Of these binder resins, polystyrene resin is most widely employed because of its excellent crushability, water-resistance and fluidity.

Polystyrene resin, however, is readily plasticized by plasticizers. Therefore, when a copy paper which bears toner images reproduced by a toner containing polystyrene resin is placed in a folder made of a polyvinyl chloride sheet in close contact therewith for a while, the polystyrene resin contained in the toner is plasticized by a plasticizer contained in the polyvinyl chloride sheet, so that when the copy paper is separated from the folder, the fixed toner images are partially or totally transferred to the surface of the folder, staining both the folder and the copy paper. The above problem is also caused when images are reproduced by a toner containing polyester resin as the binder resin.

In order to prevent such transfer of toner images to a sheet of polyvinyl chloride, it has been proposed to blend epoxy resin, which is not plasticized by an ordinary plasticizer employed in polyvinyl chloride, with the polystyrene resin or polyester resin as disclosed in Japanese Laid-Open Patent Applications 60-263951 and 61-240252.

However, when toners comprising a mixed binder resin consisting of different types of resins as mentioned above are employed for the production of images, problems such as the so-called off-set phenomenon and the curling of toner-image-bearing copy paper are caused by the incompatibility between the different resins used in the binder resin. In addition, some other problems occur with the glossiness of toner images, and the coloring performance and transparency of the toners.

These problems cannot be completely solved even by use of conventional modified epoxy resins, for instance, acetylated epoxy resin which is disclosed in Japanese Laid-Open Patent Application 61-235852.

Further, in recent dry-type electrophotography, rollers coated with silicone rubber o with highly durable Teflon are employed as thermal image fixing rollers. In general, a Teflon-coated roller has a relatively rough and hard surface, so that there is a demand for a toner with improved image-fixing performance which is capable of forming glossy toner images, without causing the problems of the off-set of toner images and the curling of toner-image-bearing copy sheets.

Furthermore, when an epoxy resin is used alone, it has the following problems in addition to the aforementioned problems:

(1) Epoxy resin readily reacts with amines to form a hardened epoxy resin with a cross-linked structure. Therefore, when kneading epoxy resin with, for example, dyes, pigments and charge controlling agents of an amine type, there is the risk that the epoxy resin is hardened and the resulting mixture cannot be used as a dry-type toner for electrophotography.

(2) The epoxy groups contained in epoxy resin are biochemically active and stimulative to the human skin, so that great care must be taken when handling epoxy resin.

(3) The epoxy groups of epoxy resin are hydrophilic, so that the epoxy resin absorbs water under the conditions of high temperatures and high humidities. When the epoxy resin absorbs water, the chargeability of a toner which contains such an epoxy resin is decreased and the toner is deposited on the background of copy paper, and it becomes difficult to clean a toner-deposited photoconductor.

It is a common practice to use epoxy resin together with a coloring agent and a charge controlling agent in a dry-type toner for electrophotography. However, when preparing the toner, it is quite difficult to disperse a coloring agent and a charge controlling agent homogeneously in an epoxy binder resin. When the coloring agent is not well dispersed, the color of toner images becomes dull and the color density thereof decreases; and when the charge controlling agent is not well dispersed, the toner particles are not uniformly charged, which brings about problems such as toner deposition on the background of copy sheets, the scattering of toner particles, the decrease of image density, the formation of unclear-cut images, and difficult cleaning of the photoconductor.

Japanese Laid-Open Patent Application 61-219051 discloses a toner which contains as a binder an ester-modified epoxy resin with ⊖-caprolactone. This ester-modified epoxy resin can improve the plasticizer-resistance and fluidity of the toner. However, in this modification, the epoxy resin is esterified in a ratio of 3 wt. % to as high as 90 wt. %, so that the softening point of the resin becomes excessively low. By using a toner containing such an ester-modified resin, glossy images can never be produced.

Japanese Laid-Open Patent Application 52-86334 discloses a toner having positive chargeability, which is prepared by reacting a primary or secondary aliphatic amine with terminal epoxy groups contained in an epoxy resin. However, as mentioned previously, the epoxy groups and an amine compound tend to react to form a cross-linked epoxy resin, so that there is the risk that the resin becomes unusable for the toner. Further, by the above reaction, it is difficult to control the charging-level of the resin as desired, although the resin can be charged to a positive polarity.

Japanese Laid-Open Patent Application 52-156632 discloses that one or both of the terminal epoxy groups of an epoxy resin are reacted with alcohol, phenol, a Grignard reagent, sodium organic acid acetylide or alkyl chloride. However, if the resulting compound contains an unreacted epoxy group, the properties of the epoxy resin, such as reactivity with amines, toxicity, and hydrophilic property, become problems again as mentioned previously. In addition, some of the above compounds which are employed for the reaction with the epoxy resin are hydrophilic, and have adverse effects on the chargeability and crushability of the toner. Therefore, it can be said that these compounds are not useful in practice.

SUMMARY OF THE INVENTION

It is therefore an object of the present invention to provide a dry type toner for electrophotography having excellent reproducibility of color images.

Another object of the present invention is to provide a dry type toner for electrophotography capable of producing glossy images without giving rise to the problems of off-set phenomenon and the curling of an image-bearing sheet even when a thermal image fixing roller is used for image fixing.

A further object of the present invention is to provide a dry type toner for electrophotography which is stable to amine compounds and has no biochemical activity.

Yet another object of the present invention is to provide a dry type toner for electrophotography which is stable to the environmental conditions.

A still further object of the present invention is to provide a dry type toner for electrophotography capable of producing images which are not transferred to a polyvinyl chloride sheet when placed in close contact therewith.

A further object of the present invention is to provide a dry type toner for electrophotography comprising a binder resin which has high compatibility with other resins, in which dyes and pigments can be well dispersed.

These objects of the present invention can be attained by a dry type toner for electrophotography comprising as the main components a coloring agent and a polyol resin serving as a binder resin which is prepared as follows:

The polyol resin for use in the present invention can be prepared by subjecting a bisphenol-type epoxy resin to the following reaction steps (1), (2) and (3), or steps (2) and (3) in any sequential combination until substantially no epoxy groups remain in the bisphenol-type epoxy resin:

Step (1): causing the epoxy groups contained in the bisphenol-type epoxy resin to react with a primary amine.

Step [2): causing the epoxy groups to react with a compound containing therein one active hydrogen in one molecule thereof.

Step (3): esterifying at least part of secondary hydroxyl groups in the epoxy resin and secondary hydroxyl groups produced in Steps (1) and (2).

DETAILED DESCRIPTION AND THE PREFERRED EMBODIMENTS

The polyol resin for use in the present invention can be derived from, for example, a bisphenol type epoxy resin having the following formula:

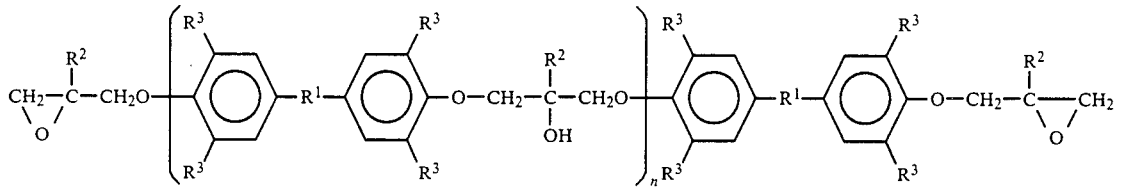

(I)

wherein $R^1$ represents

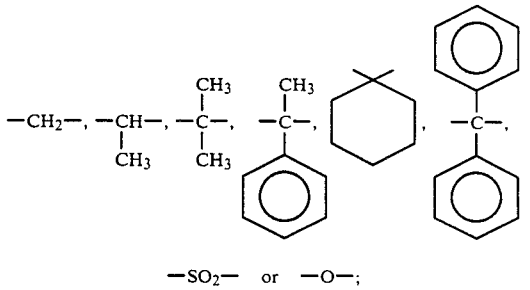

$-SO_2-$ or $-O-$;

$R^2$ represents hydrogen or a methyl group;

$R^3$ represents hydrogen or a halogen; and n is a number of repetition units, which may be zero.

A representative example of the epoxy resin for use in the present invention is a polycondensated compound between 2,2-bis(4-hydroxyphenyl)propane (Bisphenol A) and epichlorohydrin. Commercially available epoxy resins of this type are EPOMIC R301, EPOMIC R302, EPOMIC R304, EPOMIC R304P, EPOMIC R307, EPOMIC R309, EPOMIC R362, EPOMIC R363, EPOMIC R364, EPOMIC R365, EPOMIC R366, EPOMIC R367 (all made by Mitsui Petrochemical Industries, Ltd.).

Epoxy resins having various softening points, which are prepared by a polyaddition reaction between liquid epoxy resins and bisphenols, can also be employed in the present invention. Commercially available epoxy resins of this type are EPOMIC R139, EPOMIC R140, and EPOMIC R140P made by Mitsui Petrochemical Industries, Ltd.).

Bisphenols for use in the above reaction are, for example, 2,2-bis(4-hydroxy-phenyl)propane (Bisphenol A), bis(4-hydroxyphenyl)methane (Bisphenol F), and 1,1-bis(4-hydroxyphenyl)ethane (Bisphenol AD).

Specific examples of the above bisphenol type epoxy resin are glydidyl ethers and $\beta$-methyl glycidyl ethers of the above 2,2-bis(4-hydroxyphenyl)propane (Bisphenol A), bis(4-hydroxyphenyl)methane (Bisphenol F), and 1,1-bis(4hydroxyphenyl)ethane (Bisphenol AD). Of these glycidyl ethers, glycidyl ether of 2,2-bis(4-hydroxyphenyl)propane is preferable for use in the present invention.

Generally the epoxy equivalent of the bisphenol type epoxy resin is in the range of 150 to 3,500, preferably in the range of 160 to 2,500.

Examples of a primary amine employed in the previously mentioned Step (1) in which the epoxy groups contained in the bisphenol-type epoxy resin are caused to react with the primary amine are as follows:

(1) Primary aliphatic amines: propylamine, butylamine, hexylamine, octylamine, laurylamine, stearylamine, palmitylamine, and oleylamine. Of such primary aliphatic amines, primary amines having 6 to 20 carbon atoms are preferable for use in the present invention.

(2) Primary aromatic amines: aniline, toluidine, xylidine, cumidine, hexylaniline, nonylaniline, and dodecylaniline. Of these aniline derivatives, those having at the benzene ring thereof an alkyl group having 3 to 20 carbon atoms are preferable for use in the present invention.

(3) Primary alicyclic amines: Alicyclic amines having 6 to 20 carbon atoms, such as cyclopentylamine, cyclohexylamine, and norbonylamine, are preferable for use in the present invention.

(4) Primary aliphatic amines having aromatic substituents: Primary aliphatic amines with aromatic substituents, having 7 to 15 carbon atoms, such as benzylamine, phenethylamine, 4-phenyl-3-methylbutylamine, and cinnamylamine., are preferable for use in the present invention.

Of the above primary amines, the aliphatic amines having 8 to 20 carbon atoms are particularly preferable for use in the present invention. In particular, by the introduction of the amines having relatively long-chained alkyl groups into the epoxy resin, the dispersability of pigments and dyes in the epoxy resin can be improved and accordingly high compatibility with other resins employed in the toner can also be attained.

By the introduction of the amines into the epoxy resin, the produced polyol resin exhibit positive chargeability. The thus obtained positive chargeability is much more stable than that obtained by use of conventional charge controlling agents or by blending with nitrogen-containing polymers. Further, the charging level of the toner according to the present invention can be controlled by adjusting the amount of the amines introduced into the epoxy resin.

The amines can be introduced into the epoxy resin in an amount ranging from 0.01 to 50 parts by weight to 100 parts by weight of the bisphenol type epoxy resin. In the present invention, it is preferable to introduce the amines into the bisphenol type epoxy resin in an amount of 0.01 to 1.00 part by weight to 100 parts by weight of the bisphenol type epoxy resin.

Examples of a compound containing an active hydrogen employed in the previously mentioned Step (2) in which the epoxy groups contained in the bisphenol-type epoxy resin are caused to react with the active-hydrogen-containing compound are as follows:

(1) Secondary amines: Secondary amines having 6 to 40 carbon atoms, such as dipropylamine, dibutylamine, dihexylamine, dicylohexylamine, dioctylamine, distearylamine, N-methylaniline, and N-ethylaniline, are preferable for use in the present invention.

(2) Monophenols: Monophenols having 6 to 40 carbon atoms, such as phenol, cresol, isopropylphenol, aminophenol, nonylphenol, dodecylphenol, xylenol, and p-cumylphenol, are preferable for use in the present invention.

(3) Monocarboxylic acids: acetic acid, propyonic acid, capric acid, lauric acid, myristic acid, palmitic acid, stearic acid, acrylic acid, oleic acid, margaric acid, arachic acid, linoleic acid, linolenic acid, castor oil fatty acid, and tall oil fatty acid; Of these, monocarboxylic acids having 6 to 25 carbon atoms are preferable for use in the present invention. The above-enumerated compounds can be use alone or in combination.

In Step (2), bisphenols, for example, a bisphenol having the following formula, can also be present in the reaction mixture of the bisphenol type epoxy resin and a compound having an active hydrogen:

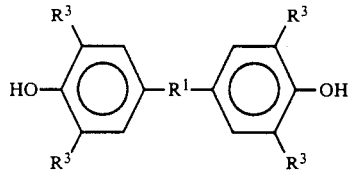

wherein $R^1$ and $R^3$ are respectively the same as defined in the previously described formula (I). In this case, it is not always necessary that the bisphenols have the same skeleton as that of the bisphenol type epoxy resin, but it is preferable that both have the same skeleton.

When Step (2) is carried out in the presence of the bisphenols, the epoxy equivalent of the bisphenol type epoxy resin is in the range of 150 to 500, preferably in the range of 160 to 400.

It is preferable that the amount of the primary amine employed in Step (1) and the amount of the active-hydrogencontaining compound employed in Step (2) satisfy the following two equations (1) and (2):

$$\frac{(A/X)}{2B/Mb + C/Mc + 2D/Md} = 0.95 \text{ to } 1.05 \quad (1)$$

$$\frac{2(A + B + C + D)}{C/Mc + |A/X - 2B/Mb - C/Mc - 2D/Md|} = \quad (2)$$

2,000 or 15,000 more preferably 3,000 or 10,000 wherein A represents the amount g) of the bisphenol type epoxy resin; B, the amount (g) of the primary amine; C, the amount of the active-hydrogen-containing compound; D, the amount of the bisphenol employed in Step (2); X, the epoxy equivalent of the bisphenol type epoxy resin; Mb, the molecular weight of the primary amine; Mc, the molecular weight of the active-hydrogen-containing compound; and Md, the molecular weight of the bisphenol.

Examples of an esterifying agent employed in the previously mentioned Step (3) in which at least part of secondary hydroxyl groups contained in the epoxy resin is esterified are as follows:

(1) Monocarboxylic acids: acetic acid, propyonic acid, capric acid, lauric acid, myristic acid, palmitic acid, stearic acid, acrylic acid, oleic acid, margaric acid, arachic acid, linoleic acid, linolenic acid, castor oil fatty acid, and tall oil fatty acid; Of these, monocarboxylic acids having 6 to 25 carbon atoms are preferable for use in the present invention.

(2) Monocarboxylic acid esters: lower alkylesters of the above-enumerated monocarboxylic acids. Of these, methyl esters and ethyl esters are preferable for use in the present invention.

(3) Lactones: p-propyolactone, δ-valerolactone, ε-caprolactone, β-butylolactone, γ-valerolactone. Of these lactones, β-butylolactone and ε-caprolactone are particularly preferable for use in the present invention.

When lactones are employed as the esterifying agent for the epoxy resin, it is preferable to use lactones in such a manner that the graft-polymerized polyester stemmed from the secondary hydroxyl groups of the epoxy resin is formed in an amount of 0.5 to 30 wt. %, more preferably in an amount of 2 wt. % to 20 wt. %, in the finally obtained polyol resin.

When monocarboxylic acids and esters thereof are employed as esterifying agents, it is preferable to use monocarboxylic acids or esters thereof in such an amount that the amount of the produced ester groups is in the range of 0.5 to 30 mole %, preferably in the range of 1 to 20 mole %, to the total of the hydroxyl groups and ester groups of the finally obtained polyol resin.

Any of the above esterifying agents is used in an amount equimolar to the number of the hydroxyl groups contained in the epoxy resin.

The epoxy resin contains two epoxy groups in one molecule at the opposite terminals. The ring-structure of these two terminal epoxy groups are cleaved when reacted with any of the above-mentioned compounds to produce a polyol resin The thus obtained polyol resin is chemically and environmentally stable, and has no biochemical activity.

The softening point of the polyol resin according to the present invention is determined by three factors, that is, a type of epoxy resin used as a starting material, the number of carbon atoms contained in a compound with which the epoxy resin is esterified, and the esterification ratio. It is also possible to determine the image-fixing property of toner by controlling the above three factors. Thus, the objects of the present invention can be attained by introduction of any of the previously mentioned amines into the epoxy resin, conducting esterification of the epoxy resin and cleavage of the terminal epoxy groups in the epoxy resin. These modifications never impede one another.

In Step (1), the reaction between the epoxy groups of the bisphenol type epoxy resin and the primary amines is carried out in the presence of a catalyst, or without any catalyst, at a temperature in the range of 50° C. to 250° C., preferably at a temperature in the range of 100° C. to 200° C., for about 2 to about 5 hours.

Examples of the catalyst employed in Step (1) are alkaline metal hydroxides such as sodium hydroxide, potassium hydroxide, lithium hydroxide; alkaline metal alcolates such as sodium methylate; alkaline metal salts such as lithium chloride, lithium carbonate; tertiary amines such as dimethylbenzylamine, triethylamine, and pyridine; quaternary ammoniums such as tetramethylammonium chloride, and benzyltrimethylammonium chloride; organic phosphates such as methyl iodide adducts of triphenyl phosphine, and triethylphosphine; alkaline metal salts such as sodium carbonate, lithium chloride; and Lewis acids such as boron trifluoride, aluminum chloride, lead tetrachloride, and boron trifluoride diethyl etherate.

The amount of such catalysts to be employed is different, depending upon the reaction temperature, but usually in the range of 0.01 to 10,000 ppm, preferably in the range of 0.1 to 1,000 ppm.

The above reaction can be carried out without using any solvents, but when a solvent is used, solvents having no active hydrogens, for example, hydrocarbon solvents such as toluene and xylene; and ketones such as methyl isobutyl ketone, methyl ethyl ketone, and cyclohexanone, can be used.

Step (2) can be carried out at the same reaction temperatures for the same reaction time, by using the same catalysts and reaction solvents as in the above-mentioned Step (1).

The esterification of the secondary hydroxyl groups in Step (3) is carried out in the presence of a catalyst or without using any catalysts, at a temperature in the range of 80° C. to 250° C., preferably at a temperature in the range of 100° C. to 200° C., for about 3 to 10 hours.

When monocarboxylic acids are employed as esterifying agents, it is preferable to remove produced water from the reaction system to complete the esterification reaction. For example, when a Dean-Stark trap is employed, the produced water can be eliminated from the reaction mixture by isobaric distillation of the azeotropic mixture of the water and a water-insoluble solvent at atmospheric pressure or under reduced pressure. When no solvent is employed, the water can be removed by merely carrying out the esterification reaction under reduced pressure.

When monocarboxylic acid esters are employed as esterifying agents, lower alcohols are produced in the esterification reaction. The lower alcohols can be removed from the reaction system by carrying out the reaction under reduced pressure.

Examples of a catalyst for the esterification reaction are organic and inorganic titanium tetrachlorides such as tetrabutyl titanate, tetraethyl titanate, butoxy titanium trichloride, and titanium tetrachloride; organic and inorganic aluminum compounds such as triethyl aluminum, ethylaluminum chloride, and aluminum trichloride; organic and inorganic zinc compounds such as diethyl zinc, and zinc chloride; organic and inorganic tin compounds such as dibutyltin laurate, and stannous chloride; acids such as p-toluenesulfonic acid, and phosphoric acid; alkaline metals such as lithium, and sodium; alkaline metal hydroxides such as lithium hydroxide, and sodium hydroxide; alkaline metal salts such as sodium carbonate, lithium acetate, lithium chloride; and tertiary amines such as triethylamine and pyridine.

These catalysts are employed in an amount of about 0.01 to about 1,000 ppm, preferably in an amount of about 0.1 to about 500 ppm, to the amount of the bisphenol type epoxy resin to be esterified.

The esterification reaction can be carried out without solvents, but when a solvent is employed, solvents such as toluene, xylene, methylisobutyl ketone, methyl ethyl ketone, and cyclohexanone can be employed.

In the present invention, Steps (1), 2) and (3) can be performed in any sequence. Step (1) can be omitted when amines are not introduced into the epoxy resin.

When the above three steps are employed, the following sequences are preferable:

Sequence 1: Step (1), Step (2) and Step (3).

Sequence 2: Step (2), Step (1) and Step (3).

Sequence 3: Step (1) and Step (2) simultaneously, and then Step (3).

Step (3) can be carried out first, although this is not a preferable sequence. When Step (3) is performed first, if a carboxylic acid is employed as esterification agent, the carboxylic acid also reacts with the epoxy groups of the epoxy resin, so that Step (2) can also be performed at the same time. If the reaction between the carboxylic acid and the epoxy groups is insufficient, Step (2) can be carried out again.

The thus obtained polyol resin contains substantially no epoxy groups. The hydroxyl value of the polyol resin is about 150 to about 250 KOHmg/g. The softening point thereof is about 70° C. to about 180° C., and the number average molecular weight thereof is 2,000 to 15,000.

In the dry-type toner according to the present invention, any of the following known dyes and pigments can be employed as a coloring agent: carbon black, Nigrosine dye, iron black, Naphthol Yellow S, Hansa Yellow 10G, Hansa Yellow 5G, Hansa Yellow G, Cadmium Yellow, iron oxide yellow, loess, Chrome Yellow, Titanium Yellow, Polyazo Yellow, Oil Yellow, Hansa Yellow GR, Hansa Yellow A, Hansa Yellow RN, Hansa Yellow R, Pigment Yellow L, Benzidine Yellow G, Benzidine Yellow GR, Permanent Yellow NCG, Vulcan Fast Yellow 5G, Vulcan Fast Yellow R, Tartrazine Lake, Quinoline Yellow Lake, Anthrazane Yellow BGL, Isoindolino Yellow, red iron oxide, red lead, vermilion lead, Cadmium Red, Cadmium Mercury Red, Antimony Red, Permanent Red 4R, Para Red, Faisey Red, Parachloro-orthonitro Aniline Red, Lithol Fast Scarlet G, Brilliant Fast Scarlet, Brilliant Carmine BS, Permanent Red F2R, Permanent Red F4R, Permanent Red FRL, Permanent Red FRLL, Permanent Red F4RH, Fast Scarlet VD, Vulcan Fast Ruby B, Lithol Red, Lake Red C, Lake Red D, Anthocyne B, Brilliant Scarlet G, Lithol Ruby GK, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Lite, BON Maroon Medium, Eosine Lake, Rhodamine Lake B, Rhodamine Lake Y, Alizarine Lake, Thioindigo Red B, Thioindigo Maroon, Oil Red, Quinacridone Red, Pyrazolone Red, Polyazo Red, Chrome Vermilion, Bendizine Orange, Perinon Orange, Oil Orange, Cobalt Blue, Cerulean Blue, Alkali Blue Lake, Peacock Blue Lake, Victoria Blue Lake, non-metal Phthalocyanine Blue, Phthalocyanine Blue, Fast Sky Blue, Indanthrene Blue RS, Indanthrene Blue BC, Indigo, Ultramarine, Prussian Blue, Anthraquinone Blue, Fast Violet B, Methyl Violet Lake, Cobalt Violet, Manganese Violet, Dioxane Violet, Anthraquinone Violet, Chrome Green, Zinc Green, chrome oxide, pyridine, Emerald Green, Pigment Green B, Naphthol Green B, Green Gold, Acid Green Lake, Maracite Green Lake, Phthalocyanine Green, Anthraquinone Green, titanium oxide, zinc flower, and lithopone.

The above-enumerated dyes and pigments are employed alone or in combination, in an amount of 0.1 to 50 parts by weight to 100 parts by weight of the binder resin.

In order to prevent the so-called off-set phenomenon, different types of resins and waxes can be incorporated into the toner according to the present invention. Examples of such resins and waxes include polymers of styrene or substituted styrene derivatives such as polystyrene, poly-p-chlorostyrene and polyvinyl toluene; styrene copolymers such as styrene—p-chlorostyrene copolymer, styrene—propyrene copolymer, styrene—vinyltoluene copolymer, styrene—vinylnaphtharene copolymer, styrene-methylacrylate copolymer, styrene—-ethylacrylate copolymer, styrene—butylacrylate copolymer, styrene—octylacrylate copolymer, styrene—methylmethacrylate copolymer, styrene-ethylmethacrylate copolymer, styrene -butylmethacrylate copolymer, styrene—o-methylchloromethacrylate copolymer, styrene—acrylonitrile copolymer, styrene—vinylmethyl ether copolymer, styrene—vinylethylether copolymer, styrene—vinylmethylketone copolymer, styrene—butadiene copolymer, styrene—isoprene copolymer, and styrene-acrylonitrile—indene copolymer; polyvinyl chloride; polyvinyl acetate; polyethylene; polypropyrene; silicone resin; polyester; polyurethane; polyamide; epoxy resin; polyvinyl butyral; rosin; modified rosin; terpene resin; phenol resin; xylene resin; aliphatic resin; aliphatic hydrocarbon resin; aromatic petroleum resin; chlorinated paraffin; and paraffin wax.

The polyol resin of the present invention has high compatibility with other resins of different type, so that such resins can be employed together with the polyol resin to prepare the toner according to the present invention. However, when using these resins, care must be taken that they do not have adverse effects on the transparency and color formation of produced images, and image-fixing performance of the toner.

The chargeability of the polyol resin for use in the present invention is well controlled by itself. However, a charge controlling agent agent can also be employed in combination with the polyol resin, when necessary. Any of the following known charge controlling agents can be in the present invention: Nigrosine dyes, triphenyl methane dyes, chrome-containing metal complex dyes, molybdic acid chelate pigments, rhodamine dyes, alkoxyl amines, quaternary ammonium salts, alkyl amides, phosphorus, phosphorous compounds, tungsten, tungsten compounds, fluorine active agents, metal salts of salicylic acid, metal salts of salicylic acid derivatives, and hydrophobic silica.

Other auxiliary additives such as colloidal silica, hydrophobic silica, silicone oil, metal soap, nonion surface active agents, metal salts of fatty acid ex. zinc stearate, aluminum stearate), metal oxides ex. titanium oxide, aluminum oxide, tin oxide, antimony oxide), and fluoro polymers, can also be employed.

The toner of the present invention comprising the above-described components is usable as a two-component type developer in combination with a carrier. It is also usable as a mono-component type developer by incorporating a carrier into the toner.

Any known carriers such as iron powder, ferrite, and glass beads, can be used as the above carrier. Carriers which are coated with resin are also employable in the above. Examples of such a resin used for coating the carriers include polycarbon fluoride, polyvinyl chloride, polyvinylidene chloride, phenol resin, polyvinyl acetal, and silicone resin.

A suitable proportion of the toner to the carrier is approximately (0.5–6.0):100 on a parts-by-weight basis.

This invention will now be explained more specifically by referring to the following examples, which are given for illustration of the invention and are not intended to be limiting thereof.

EXAMPLE 1-1

200 g of an epoxy resin of a bisphenol A type (trademark "EPOMIC R140P", made by Mitsui Petrochemical Industries, Ltd.), 110 g of bisphenol A, 20 g of p-cumylphenol, and 50 ml of xylene were placed in a separable flask equipped with an agitator, a thermometer, a nitrogen gas-introducing tube and a condenser, and the mixture was heated to 70° C. in an atmosphere of nitrogen. An aqueous 5N lithium chloride solution was added to the mixture, and then heated to 185° C. While heating, the xylene was removed from the mixture under reduced pressure. Thereafter, the mixture was stirred for reaction for 5 hours at atmospheric pressure, followed by addition of 17 g of ε-caprolactone and stirring of an additional 6 hour, whereby a polyol resin (Resin A-1) having a softening point of 145° C. was prepared.

Epoxy groups were not detected in Resin A-1 by an analysis using hydrochloric acid—dioxane.

Color toners each having the following formulations given below were prepared in a below-described manner. Namely, all components of each formulation given below were kneaded by a thermal-roll mill, and then cooled. The resulting each mixture was roughly crushed by a hammer mill, pulvarized into fine powder by an air-jet crusher, and subjected to classification to obtain each color toner of fine powder having a particle size of 5 to 15 μm.

| | parts by weight |
|---|---|
| [Formulation of Yellow Toner] | |
| Resin A-1 | 100 |
| Yellow Pigment (Trademark "LIONOL YELLOW FGN-T", made by Toyo Ink Mfg. Co., Ltd.) | 5 |
| "TP-302" (made by Hodogaya Chemical Co., Ltd.) | 1 |
| [Formulation of Magenta Toner] | |
| Resin A-1 | 100 |
| Red Dye (Trademark "OIL PINK #312", made by Orient Chemical Industries, Ltd.) | 4 |
| "TP-302" | 1 |
| [Formulation of Cyan Toner] | |
| Resin A-1 | 100 |
| Blue Pigment (Trademark "LIONOL BLUE FG-7351", made by Toyo Ink Mfg. Co., Ltd.) | 2 |
| "TP-302" | 1 |

Although the red dye used for preparing the magenta toner was an amine type, no cross-linking reaction was taken place while kneading the components of the toner.

3.5 parts by weight of the above-prepared each color toner and 96.5 parts by weight of a carrier of iron powder trademark "TEFV 23", made by Nihon Teppun Co., Ltd.) were admixed to prepare two-component type developers of each color.

The thus prepared each developer was placed in a commercially available electrophotographic color-copying machine (trademark "COLOR 3000" modified, made by Ricoh Company, Ltd.), and latent electrostatic images were developed. The toner images of each color were transferred to copying paper, and fixed by a thermal image fixing roller. Thus clear images in the single color of yellow, magenta and cyan, each having a mean glossiness of 20%, were obtained, respectively.

Clear images in red, blue and green, each having a mean glossiness of 20%, were also obtained by two-color-superimposing development using the above-prepared developers. Further, clear images of full-color having a mean glossiness of 18% were obtained by three-color-superimposing development. In the above image-forming test, the lowest limit of image-fixing temperature was 110° C., and a hot-off set phenomenon occurred at 180° C.

When full-page images were produced on copying paper by three-color-superimposing development, curl of the copying paper, especially at the corner of the paper, was not found.

The above image-forming test was also carried out under the conditions of high temperature and humidity (30° C.×90% RH). As a result, clear and sharp full-color images without deposition of the toner on the background were produced.

Further, full-color images were fixed on a transparent sheet for an over head projector OHP), and projected by an OHP. The projected full-color images were also clear and transparent.

Copying paper which bears full-color images was brought into close contact with a sheet of vinylchloride resin, and preserved at room temperature for 180 hours. The full-color images were unchanged during the preservation, and no transference of the toner to the vinylchloride sheet was observed at all.

By using Resin A-1, black toner was prepared in the same manner as described above. The formulation of the toner is as follows.

| [Formulation of Black Toner] | parts by weight |
|---|---|
| Resin A-1 | 100 |
| Carbon Black #44 (Mitsubishi Carbon Co., Ltd.) | 12 |
| Nigrosine Base EX (Orient Chemical Industries, Ltd.) | 1 |

A developer was prepared using the black toner in the above-described manner, and an image-forming test was carried out by using the developer and a commercially available electrophotographic copying machine trademark "FT 4820", made by Ricoh Company, Ltd.). As a result, clear images having a mean glossiness of 20% were obtained. In the above test, the lowest limit of image-fixing temperature was 110° C., and a hot-off set phenomenon occurred at 180° C. Even under the conditions of high temperatures and humidities, clear and sharp images were produced, and no transference of the toner to a vinylchloride sheet was observed.

EXAMPLE 1-2

The preparation manner for Resin A-1 in Example 1-1 was repeated except that p-cumylphenol was replaced with p-nonylphenol, whereby a polyol resin (Resin B-1) having a softening point of 144° C. was prepared.

Epoxy groups were not detected in Resin B-1 by the same analysis as in Example 1-1.

By using Resin B-1, yellow, magenta, and cyan toners were each prepared in the same manner as in Example 1-1. In the course of kneading the components of each toner, no cross-linking reaction was taken place, and fine toners of each color were prepared.

Yellow, magenta and cyan developers were prepared using the above-prepared each toner, and subjected to an image-forming test in accordance with single-color, two-color-superimposing and three-color-superimposing developments. Images produced by any one of the above development methods were clear, and the mean glossiness was 23%. In the above test, the lowest limit of image-fixing temperature was 110° C., and a hot-off set phenomenon occurred at 180° C.

When full-page images were produced on copying paper by three-color-superimposing development, curl of the copying paper, especially at the corner of the paper, was not found. Further, even under the conditions of high temperatures and humidities, clear and sharp images were produced. Images projected by an OHP were also clear and transparent, and no transference of the toner to a vinylchloride sheet was observed.

EXAMPLE 1-3

The preparation manner for Resin A-1 in Example 1-1 was repeated except that p-cumylphenol was replaced with stearic acid, whereby a polyol resin (Resin C-1) having a softening point of 145° C. was prepared.

Epoxy groups were not detected in Resin C-1 by the same analysis in Example 1-1.

By using Resin C-1, yellow, magenta and cyan toners were each prepared in the same manner as in Example 1-1. In the course of kneading the components of each toner, no cross-linking reaction was taken place, and fine toners of each color were prepared.

Yellow, magenta and cyan developers were prepared using the above-prepared each toner, and subjected to an image-forming test in accordance with single-color, two-color-superimposing and three-color-superimposing developments. Images produced by any one of the above development methods were clear, and the mean glossiness was 23%. In the above test, the lowest limit of image-fixing temperature was 110° C., and a hot-off set phenomenon occurred at 180° C.

When full-page images were produced on copying paper by three-color-superimposing development, curl of the copying paper, especially at the corner of the paper, was not found. Further, even under the conditions of high temperatures and humidities, clear and sharp images were produced. Images projected by an OHP were also clear and transparent, and no transference of the toner to a vinylchloride sheet was observed.

EXAMPLE 1-4

200 g of an epoxy resin of a bisphenol A type (trademark "EPOMIC R140P"), 110 g of bisphenol A, 20 g of p-cumyl-phenol, and 50 ml of xylene were placed in a separable flask equipped with an agitator, a thermometer, a nitrogen gas-introducing tube and a condenser, and the mixture was heated to 70° C. in an atmosphere of nitrogen. An aqueous 5N lithium chloride solution was added to the mixture, and then heated to 185° C. While heating, the xylene was removed from the mixture under reduced pressure. After stirring the mixture for 5 hours at atmospheric pressure, the separable flask was further equipped with a Dean-Stark trap, and 17g of stearic acid and 30 ml of xylene were added. Then the mixture was subjected to esterification for 6 hours at elevated temperatures of 180° to 190° C. while refluxing the xylene, whereby a polyol resin (Resin D-1) having a softening point of 144° C. was prepared.

Epoxy groups were not detected in Resin D-1 by the same analysis as in Example 1-1.

By using Resin D-1, yellow, magenta and cyan toners were each prepared in the same manner as in Example 1-1. In the course of kneading the components of each toner, no cross-linking reaction was taken place, and fine toners of each color were prepared.

Yellow, magenta and cyan developers were prepared using the above-prepared each toner, and subjected to an image-forming test in accordance with single-color, two-color-superimposing, and three-color-superimposing developments. Images produced by any one of the above development methods were clear, and each had a mean glossiness of 23%. In the above test, the lowest limit of image-fixing temperature was 110° C., and a hot-off set phenomenon occurred at 180° C.

When full-page images were produced on copying paper by three-color-superimposing development, curl of the copying paper, especially at the corner of the paper, was not found. Further, even under the conditions of high temperatures and humidities, clear and sharp images were produced. Images projected by an OHP were also clear and transparent, and no transference of the toner to a vinylchloride sheet was observed.

EXAMPLE 1-5

By using 200 g of an epoxy resin of a bisphenol A type (trademark "EPOMIC R140P"), 112 g of bisphenol A, 24 g of p-cumylphenol and 18 g of ε-caprolactone, a polyol resin (Resin E-1) having a softening point of 130° C. was prepared in the same manner as in Example 1-1.

By using Resin E-1, yellow, magenta and cyan toners were each prepared in the same manner as in Example 1-1. In the course of kneading the components of each toner, no cross-linking reaction was taken place, and fine toners of each color were prepared.

Yellow, magenta and cyan developers were prepared using the above-prepared each toner, and subjected to an image-forming test in accordance with single-color, two-color-superimposing and three-color-superimposing developments. Images produced by any one of the above development methods were clear, and each had a mean glossiness of 23%. In the above test, the lowest limit of image-fixing temperature was 100° C., and a hot-off set phenomenon occurred at 170° C.

When full-page images were produced on copying paper by three-color-superimposing development, curl of the copying paper, especially at the corner of the paper, was not found. Further, even under the conditions of high temperatures and humidities, clear and sharp images were produced. Images projected by an OHP were also clear and transparent, and no transference of the toner to a vinylchloride sheet was observed.

Black toner was prepared by using Resin E-1 in the same manner as in Example 1-1, and employed for producing images under the conditions of room temperature and normal humidity, and high temperature and high humidity. Images produced under the above conditions were all clear, and each had a mean glossiness of 23%. In the above test, the lowest limit of image-fixing temperature was 100° C., and a hot off-set phenomenon occurred at 170° C.

No transference of the toner to a vinylchloride sheet was observed.

COMPARATIVE EXAMPLE 1-1

By using an epoxy resin of a bisphenol A type (trademark "EPOMIC R368", made by Mitsui Petrochemical Industries, Ltd.), color toners of yellow, magenta and cyan were each prepared in the same manner as in Example 1-1.

In the course of preparing magenta toner, the components of the toner were cross-linked while kneading, and the mixture was solidified in a thermal-roll mill. Thus the desired magenta toner could not be prepared.

By using the above-prepared yellow and cyan toners, developers were each prepared in the same manner as in Example 1-1, and subjected to an image-forming test. Images produced by single-color development and two-color-superimposing development each had a glossiness of only 7%.

When full-page images were produced on copying paper by two-color-superimposing development, the copying paper was curled cylindrically.

Images produced under the conditions of high temperatures and humidities were unclear, and deposition of the toner on the background was observed. However, images projected by an OHP were clear and transparent, and no transference of the toner to a vinylchloride sheet was observed.

COMPARATIVE EXAMPLE 1-2

250 g of an epoxy resin of a bisphenol A type, 130 g of bisphenol A and 50 ml of xylene were placed in a separable flask equipped with an agitator, a thermometer, a nitrogen gas-introducing tube and a condenser, and the mixture was heated to 70° C. in an atmosphere of nitrogen. An aqueous 0.65N sodium hydroxide solution was added to the mixture, and the mixture was heated to 185° C. While heating, the xylene and water were removed from the mixture under reduced pressure. Thereafter, the mixture was stirred for reaction for 5 hours at atmospheric pressure, followed by addition of 19.6 g of ε-caprolactone and stirring of an additional 6 hour, whereby an esterified epoxy resin having a softening point of 140° C. was prepared. The resulting resin had epoxy groups in a chemical equivalent of 2020 g/eq.

By using this resin, yellow, magenta and cyan toners were each prepared in the same manner as in Example 1-1. In the course of preparing magenta toner, the components of the toner were cross-linked while kneading, and the mixture was solidified in a thermal-roll mill. Thus the desired magenta toner could not be obtained.

By using the above-obtained yellow and cyan toners, developers were each prepared in the same manner as in Example 1-1, and subjected to an image-forming test. Images produced by single-color development and two-color-superimposing development were clear, and each had a mean glossiness of 23%. In the above test, the lowest limit of fixing-temperature was 110° C., and a hot off-set phenomenon occurred at 185° C.

When full-images were produced on copying paper by two-color-superimposing development, curl of the copying paper, especially at the corner of the paper, was not found. However, unclear images with deposition of the toner on the background were produced under the conditions of high temperatures and humidities. Images projected by an OHP were clear and transparent, and no transference of the toner to a vinylchloride sheet was observed.

COMPARATIVE EXAMPLE 1-3

250 g of an epoxy resin of a bisphenol A type, 129 g of bisphenol A, 30 g of p-cumylphenol and 50 ml of xylene were placed in a separable flask equipped with an agitator, a thermometer, a nitrogen gas-introducing tube and a condenser, and the mixture was heated to 70° C. in an atmosphere of nitrogen. An aqueous 1.8N lithium chloride solution was added to the mixture, and then the mixture was heated to 185° C. While heating, the xylene and water were removed from the mixture under reduced pressure. Thereafter, the mixture was stirred for reaction for 5 hours at atmospheric pressure, whereby a polyol resin containing no epoxy groups, having a softening point of 142° C., was prepared.

By using this resin, yellow, magenta and cyan toners were each prepared in the same manner as in Example 1-1. In the course of the preparation, no cross-linking reaction was taken place, and desired toners of each color were prepared.

Yellow, magenta and cyan developers were each prepared using the above-prepared toners, and subjected to an image-forming test. Images produced by single-color development, two-color-superimposing development and three-color-superimposing development were all poor, and each had a mean glossiness of only 7%.

When full-page images were produced on copying paper by three-color-superimposing development, the copying paper was curled cylindrically. However, clear, sharp images were produced even under the conditions of high temperatures and humidities. No transference of the toner to a vinylchloride sheet was observed.

SYNTHESIS EXAMPLE 1

2000 g of an epoxy resin of a bisphenol A type (trademark "EPOMIC R140P", made by Mitsui Petrochemical Industries, Ltd.), 1082 g of bisphenol A, 150 g of p-cumylphenol and 250 ml of xylene were placed in a separable flask equipped with an agitator, a thermometer, a nitrogen gas-introducing tube and a condenser, and the mixture was heated to 70° C. in an atmosphere of nitrogen. While heating, water and the xylene were removed from the mixture under reduced pressure. Thereafter, 96 g of stearylamine was added to the mixture at atmospheric pressure, and stirred for reaction for 5 hours at 185° C., followed by addition of 175 g of ε-caprolactone and stirring of an additional 6 hour for reaction, whereby a polyol resin (Resin A-2) having a softening point of 143° C., containing 0.14 wt. % of nitrogen, was prepared.

SYNTHESIS EXAMPLE 2

SYNTHESIS EXAMPLE 1 was repeated except that all the starting materials used in SYNTHESIS EXAMPLE 1 were replaced with 2100 g of an epoxy resin of a bisphenol A type (trademark "EPOMIC R140P"), 1166 g of bisphenol A, 218 g of p-nonylphenol, 12 g of cyclohexyl amine and 184 g of ε-caprolactone, whereby a polyol resin (Resin B-2) having a softening point of 143° C., containing 0.04 wt. % of nitrogen, was prepared.

SYNTHESIS EXAMPLE 3

SYNTHESIS EXAMPLE 1 was repeated except that all the starting materials used in SYNTHESIS EXAMPLE 1 were replaced with 2100 g of an epoxy resin of a bisphenol A type (trademark "EPOMIC R140P"), 1172 g of bisphenol A, 201 g of p-cumylphenol, 23 g of laurylamine and 71 g of ε-caprolactone, whereby a polyol resin (Resin C-2) having a softening point of 143° C., containing 0.04 wt. % of nitrogen, was prepared.

SYNTHESIS EXAMPLE 4

SYNTHESIS EXAMPLE 1 was repeated except that all the starting materials used in SYNTHESIS EXAMPLE 1 were replaced with 2087 g of an epoxy resin of a bisphenol A type (trademark "EPOMIC R140P"), 1061 g of bisphenol A, 183 g of p-nonylphenol, 168 g of stearylamine and 71 g of ε-caprolactone, whereby a polyol resin (Resin D-2) having a softening point of 143° C., containing 0.24 wt. % of nitrogen, was prepared.

SYNTHESIS EXAMPLE 5

SYNTHESIS EXAMPLE 1 was repeated except that all the starting materials used in SYNTHESIS EXAMPLE 1 were replaced with 2118 g of an epoxy resin of a bisphenol A type (trademark "EPOMIC R140P"), 1146 g of bisphenol A, 165 g of p-nonylphenol, 70 g of laurylamine and 304 g of ϵ-caprolactone, whereby a polyol resin (Resin E-2) having a softening point of 144° C., containing 0.13 wt. % of nitrogen, was prepared.

SYNTHESIS EXAMPLE 6

SYNTHESIS EXAMPLE 1 was repeated except that all the starting materials used in SYNTHESIS EXAMPLE 1 were replaced with 200 g of an epoxy resin of a bisphenol A type (trademark "EPOMIC R140P"), 1028 g of bisphenol A, 157 g of p-cumylphenol, 57 g of cyclohexyl amine and 282 g of ϵ-caprolactone, whereby a polyol resin (Resin F-2) having a softening point of 142° C., containing 0.23 wt. % of nitrogen, was prepared.

SYNTHESIS EXAMPLE 7

2000 g of an epoxy resin of a bisphenol A type (trademark "EPOMIC R140P"), 1044 g of bisphenol A and 250 ml of xylene were placed in a separable flask equipped with an agitator, a thermometer, a nitrogen gas-introducing tube and a condenser, and the mixture was heated to 70° C. in an atmosphere of nitrogen. An aqueous 5N lithium chloride solution was added to the mixture, followed by elevation of temperature to 150° C. while removing the xylene from the mixture under reduced pressure.

101 g of phenol and 34 g of cyclohexyl amine were added to the reaction mixture at atmospheric pressure, and the mixture was stirred for reaction for 5 hours at 185° C., followed by addition of 65 g of ϵ-caprolactone and stirring of an additional 6 hour, whereby a polyol resin (Resin G-2) having softening point of 142° C., containing 0.15 wt. % of nitrogen, was prepared.

SYNTHESIS EXAMPLE 8

2000 g of an epoxy resin of a bisphenol A type (trademark "EPOMIC R140P"), 1082 g of bisphenol A, 150 g of p-cumylphenol and 250 ml of xylene were placed in a separable flask equipped with an agitator, a thermometer, a nitrogen gas-introducing tube and a condenser, and the mixture was heated to 70° C. in an atmosphere of nitrogen. An aqueous 5N lithium chloride solution was added to the mixture, and the mixture was heated to 185° C. While heating, water and the xylene were removed from the mixture under reduced pressure. 96 g of stearyl amine was added to the mixture at atmospheric pressure, and stirred for reaction for 5 hours at 185° C.

Thereafter, the separable flask was further equipped with a Dean-Stark trap, and stearic acid and xylene were added to the mixture to conduct an esterification reaction at elevated temperatures of 180 to 190° C. for 6 hours under reflucting the xylene. For the smooth refluction, xylene was further added to the reaction mixture when the reaction temperature exceeded 190° C. Water produced during the above reaction was azeotrophied with xylene, and removed from the mixture using the Dean-Stark trap. After completion of the esterification reaction, the xylene was removed from the mixture at the same temperature under reduced pressure, whereby a polyol resin (Resin H-2) having a softening point of 146° C., containing 0.15 wt. % of nitrogen, was prepared.

SYNTHESIS EXAMPLE 9

SYNTHESIS EXAMPLE 1 was repeated except that all the starting materials used in SYNTHESIS EXAMPLE 1 were replaced with 2500 g of an epoxy resin of a bisphenol A type (trademark "EPOMIC R140P"), 1294 g of bisphenol A, 294 g of p-cumylphenol, 12 g of stearyl amine and 22 g of ϵ-caprolactone, whereby a polyol resin (Resin I-2) having a softening point of 130° C., containing 0.15 wt. % of nitrogen, was prepared.

Epoxy groups were not detected in any one of the above-prepared resins, Resins A-2 to I-2, by an analysis using hydrochloric acid—dioxane.

EXAMPLE 2-1

By using Resin A-2 prepared in SYNTHESIS EXAMPLE 1, color toners each having the following formulations were prepared in a below-described manner. Namely, all components of each formulation were kneaded by a thermal-roll mill, and then cooled. The resulting each mixture was roughly crushed by a hammer mill, pulvarized into fine powder by an air-jet crusher, and subjected to classification to obtain each color toner of fine powder having a particle size of 5 to 15 μm.

| | parts by weight |
|---|---|
| [Formulation of Yellow Toner] | |
| Resin A-2 | 100 |
| Yellow Pigment (Trademark "LIONOL YELLOW FGN-T", made by Toyo Ink Mfg. Co., Ltd.) | 5 |
| [Formulation of Magenta Toner] | |
| Resin A-2 | 100 |
| Red Dye (Trademark "OIL PINK #312", made by Orient Chemical Industries, Ltd.) | 4 |
| [Formulation of Cyan Toner] | |
| Resin A-2 | 100 |
| Blue Pigment Trademark "LIONOL BLUE FG-7351", made by Toyo Ink Mfg. Co., Ltd.) | 2 |

Although the red dye used for preparing the magenta toner was an amine type, no cross-linking reaction was taken place while kneading the components of the toner.

3.5 parts by weight of the above-prepared each toner and 96.5 parts by weight of a carrier of iron powder (trademark "TEFV 23", made by Nihon Teppun Co., Ltd.) were admixed to prepare two-component type developers of each color.

An amount of electric charges on the above-prepared each developer was measured by a blow-off method, and it was found that the yellow developer, the magenta developer and cyan developer were charged in an amount of +17.0 μC/g, +14.5 μC/g and +15.6 μC/g, respectively.

Each developer was placed in a commercially available electrophotographic color-copying machine (trademark "COLOR 3000" modified, made by Ricoh Company, Ltd.), and latent electrostatic images were developed. The toner images of each color were transferred to copying paper, and fixed by a thermal image fixing roller. Thus clear images in the single color of yellow, magenta and cyan, each having a mean glossiness of 20%, were obtained.

Clear images in red, blue and green, each having a mean glossiness of 20%, were also obtained by two-color-superimposing development. Further, clear images of full-color having a mean glossiness of 18% were obtained by three-color-superimposing development. In the above image-forming test, the lowest limit of image-fixing temperature was 110° C., and a hot-off set phenomenon occurred at 180° C.

When full-page images were produced on copying paper by three-color-superimposing development, curl of the copying paper, especially at the corner of the paper was not found.

The above image-forming test was also carried our under the conditions of high temperature and humidity (30° C.×90% RH). As a result, clear and sharp full-color images were produced without deposition of the toner on the background.

Further, full-color images were fixed on a transparent sheet for an OHP, and projected by an OHP. The projected full-color images were clear and transparent.

Copying paper on which full-color images were fixed was brought into close contact with a sheet of vinylchloride resin, and preserved at room temperature for 180 hours. The full-color images were unchanged during the preservation, and no transference of the toner to the vinylchloride sheet was observed at all.

Full-color images were continuously reproduced on 50000 sheets of copying paper. Clear, sharp images without deposition of the toner of the background were produced even on the 50000th sheet of copying paper. On the 50000th sheet of copying paper, it was found that the yellow developer, the magenta developer and the cyan developer were charged in an amount of +15.9 μC/g, +14.0 μC/g, and +14.8 μC/g, respectively.

By using Resin A-2, black toner was prepared in the same manner as described before. The formulation of the toner is as follows.

| [Formulation of Black Toner] | parts by weight |
|---|---|
| Resin A-2 | 100 |
| Carbon Black #44 (Mitsubishi Carbon Co., Ltd.) | 12 |

A developer was prepared by using the black toner in the above-described manner, and an image-forming test was carried out by using the developer and a commercially available electrophotographic copying machine (trademark "FT 4820", made by Ricoh Company, Ltd.). As a result, clear images having a mean glossiness of 20% were obtained. In the above test, the lowest limit of image-fixing temperature was 110° C., and a hot off-set phenomenon occurred at 180° C. Even under the conditions of high temperatures and humidities, clear and sharp images were produced. No transference of the toner to a vinylchloride sheet was observed.

Further, an image-forming test was continuously carried out using the black developer on 50000 sheets of copying paper. Clear and sharp images without deposition of the toner on the background were produced even on the 50000th sheet. The initial amount of electric charge was +15.3 μC/g, and +16.7 μC/g on the 50000th sheet. Thus the developer was found to be stably charged during the test.

EXAMPLE 2-2

By using Resin A-2, color toners each having the following formulations were prepared in the same manner as in Example 2-1.

| | parts by weight |
|---|---|
| [Formulation of Yellow Toner] | |
| Resin A-2 | 100 |
| Yellow Pigment (Trademark "LIONOL YELLOW FGN-T", made by Toyo Ink Mfg. Co., Ltd.) | 5 |
| "BONTRON P-51" (made by Orient Chemical Industries, Ltd.) | 1 |
| [Formulation of Magenta Toner] | |
| Resin A-2 | 100 |
| Red Dye (Trademark "OIL PINK #312", made by Orient Chemical Industries, Ltd.) | 4 |
| P-51 | 1 |
| [Formulation of Cyan Toner] | |
| Resin A-2 | 100 |
| Blue Pigment (Trademark "LIONOL BLUE FG-7351", made by Toyo Ink Mfg. Co., Ltd.) | 2 |
| P-51 | 1 |

although the red dye used for preparing the magenta toner was an amine type, no cross-linking reaction was taken place while kneading the components of the toner.

3.5 parts by weight of the above-prepared each toner and 96.5 parts by weight of a carrier of iron powder (trademark "TEFV 23", made by Nihon Teppun Co., Ltd.) were admixed to prepare two-component type developers of each color.

An amount of electric charges on the above-prepared each developer was measured by a blow-off method, and it was found that the yellow developer, the magenta developer and the cyan developer were charged in an amount of +18.6 μC/g, +16.0 μC/g and +17.2 μC/g, respectively.

An image-forming test was carried out by using these developers in the same manner as in Example 2-1. Images produced by a single-color development, two-color-superimposing development and three-color-superimposing development were all clear, and each had a mean glossiness of 23%. In the above test, the lowest limit of image-fixing temperature was 110° C., and a hot off-set phenomenon occurred at 180° C.

When full-page images were produced on copying paper by three-color-superimposing development, curl of the copying paper, especially at the corner of the paper, was not found.

Images projected by an OHP were clear and transparent, and no transference of the toner to a vinylchloride sheet was not observed.

Images produced under the conditions of high temperatures and humidities were also clear and sharp.

Further, full-color images were continuously produced on 50000 sheets of copying paper. Clear images with stable electric charges were obtained in the course of the above test.

By using Resin A-2, black toner was prepared in the same manner as described before. The formulation of the toner is as follows.

| [Formulation of Black Toner] | parts by weight |
|---|---|
| Resin A-2 | 100 |
| Carbon Black #44 (Mitsubishi Carbon Co., Ltd.) | 12 |
| Nigrosine Base EX (Orient Chemical Industries, Ltd.) | 1 |

A developer was prepared using the black toner in the above-described manner. A charge amount of the developer was +17.4 μC/g.

An image-forming test was carried out by using this developer and a commercially available electrophotographic copying machine (trademark "FT 4820", made by Ricoh Company, Ltd.). As a result, clear images having a mean glossiness of 23% were produced. In the above test, the lowest limit of image-fixing temperature was 110° C., and a hot off-set phenomenon occurred at 180° C.

Clear, sharp images were produced even under the conditions of high temperatures and humidities, and no transference of the toner to a vinylchloride sheet was observed.

Further, an image-forming test was continuously carried out on 50000 sheets of copying paper. Clear images with stable electric charges were obtained in the course of the test.

Example 2-3

By using Resin A-2, yellow, magenta and cyan toners each having the following formulations were prepared in the same manner as in Example 2-1.

| | parts by weight |
|---|---|
| [Formulation of Yellow Toner] | |
| Resin A-2 | 90 |
| Styrene-Acrylic Acid Copolymer | 10 |
| Yellow Pigment (Trademark "LIONOL YELLOW FGN-T", made by Toyo Ink Mfg. Co., Ltd.) | 5 |
| [Formulation of Magenta Toner] | |
| Resin A-2 | 90 |
| Styrene-Acrylic Acid Copolymer | 10 |
| Red Dye (Trademark "OIL PINK #312", made by Orient Chemical Industries, Ltd.) | 4 |
| [Formulation of Cyan Toner] | |
| Resin A-2 | 90 |
| Styrene-Acrylic Acid Copolymer | 10 |
| Blue Pigment (Trademark "LIONOL BLUE FG-7351", made by Toyo Ink Mfg. Co., Ltd.) | 2 |

Although the red dye used for preparing the magenta toner was an amine type, no cross-liking reaction was taken place while kneading the components of the toner.

3.5 parts by weight of the above-prepared each toner and 96.5 parts by weight of a silicone-coated carrier prepared by coating iron powder (trademark "TEFV 23", made by Nihon Teppun Co., Ltd.) with silicone resin were admixed to prepare two-component type developers of each color.

An amount of electric charges on the above-prepared each developer was measured by a blow-off method, and it was found that the yellow developer, the magenta developer and the cyan developer were charged in an amount of +18.2 μC/g, +15.7 μC/g and +16.6 μC/g, respectively.

An image-forming test was carried out by using these developers in the same manner as in Example 2-1. Images produced by a single-color development, two-color-superimposing development and three-color-superimposing development were all clear, and each had a mean glossiness of 23%. In the above test, the lowest limit of image-fixing temperature was 110° C., and a hot off-set phenomenon occurred at 195° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images were produced even under the conditions of high temperatures and humidities.

Full-color images were continuously produced on 50000 sheets of copying paper. Clear images with stable electric charges were obtained in the course of the above test.

By using Resin A-2, black toner was prepared in the same manner as described before. The formulation of the toner is as follows.

| [Formulation of Black Toner] | parts by weight |
|---|---|
| Resin A-2 | 90 |
| Styrene-Acrylic Acid Copolymer | 10 |
| Carbon Black #44 (Mitsubishi Carbon Co., Ltd.) | 12 |

A developer was prepared using the black toner in the above-described manner. A charge amount of the developer was +16.1 μC/g.

An image-forming test was carried out by using the developer and a commercially available electrophotographic copying machine (trademark "FT 4820", made by Ricoh Company, Ltd.). As a result, clear images having a mean glossiness of 23% were produced. In the above test, the lowest limit of image-fixing temperature was 110° C., and a hot off-set phenomenon occurred at 195° C.

Clear, sharp images were produced even under the conditions of high temperature and humidity, and no transference of the toner to a vinylchloride sheet was observed.

Images were continuously produced on 50000 sheets of copying paper by using the developer, and clear images with stable charges were obtained in the course of the test.

EXAMPLE 2-4

By using Resin A-2, yellow, magenta and cyan toners each having the following formulations were prepared in the same manner as in Example 2-1.

| | parts by weight |
|---|---|
| [Formulation of Yellow Toner] | |
| Resin A-2 | 90 |
| Styrene-Acrylic Acid Copolymer | 10 |
| Yellow Pigment (Trademark "LIONOL YELLOW FGN-T", made by Toyo Ink Mfg. Co., Ltd.) | 5 |
| BONTRON P-51 (made by Orient Chemical Industries, Ltd.) | 1 |
| [Formulation of Magenta Toner] | |
| Resin A-2 | 90 |
| Styrene-Acrylic Acid Copolymer | 10 |

-continued

| | parts by weight |
|---|---|
| Red Dye (Trademark "OIL PINK #312", made by Orient Chemical Industries, Ltd.) | 4 |
| BONTRON P-51 | 1 |
| [Formulation of Cyan Toner] | |
| Resin A-2 | 90 |
| Styrene-Acrylic Acid Copolymer | 10 |
| Blue Pigment (Trademark "LIONOL BLUE FG-7351", made by Toyo Ink Mfg. Co., Ltd.) | 2 |
| BONTRON P-51 | 1 |

Although the red dye used for preparing the magenta toner was an amine type, no cross-linking reaction was taken place while kneading the components of the toner.

3.5 parts by weight of the above-prepared each toner and 96.5 parts by weight of a silicone-coated carrier prepared by coating iron powder (trademark "TEFV 23", made by Nihon Teppun Co., Ltd.) with silicone resin were admixed to prepare two-component type developers of each color.

An amount of electric charges on the above-prepared each developer was measured by a blow-off method, and it was found that the yellow developer, the magenta developer and the cyan developer were electrically charged in an amount of +18.9 μC/g, +17.0 μC/g and 17.8 μC/g, respectively.

An image-forming test was carried out by using these developers in the same manner as in Example 2-1. Images produced by single-color development, two-color-superimposing development, and three-color-superimposing development were all clear, and each had a mean glossiness of 23%. In the above test, the lowest limit of image-fixing temperature was 110° C., and a hot off-set phenomenon occurred at 195° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable electric charges were obtained in the course of the above test.

By using Resin A-2, black toner was prepared in the same manner as described before. The formulation of the toner is as follows.

| [Formulation of Black Toner] | parts by weight |
|---|---|
| Resin A-2 | 90 |
| Styrene-Acrylic Acid Copolymer | 10 |
| Carbon Black #44 (Mistubishi Carbon Co., Ltd.) | 12 |
| Nigrosine Base EX (Orient Chemical Industries, Ltd.) | 1 |

A developer was prepared using the black toner in the above-described manner. A charge amount of the developer was +18.5 μC/g.

An image-forming test was carried out by using the developer and a commercially available electrophotographic copying machine (trademark "FT 4820", made by Ricoh Company, Ltd.). As a result, clear images having a mean glossiness of 23% were produced. In the above test, the lowest limit of image-fixing temperature was 110° C., and a hot off-set phenomenon occurred at 195° C.

Clear, sharp images were produced even under the conditions of high temperatures and humidities, and no transference of the toner to a vinylchloride sheet was observed.

Images were continuously produced on 50000 sheets of copying paper by using the developer, and clear images with stable electric charges were obtained in the course of the above test.

EXAMPLE 2-5

By using Resin B-2 prepared in Synthesis Example 2, yellow, magenta and cyan toners each having the following formulations were prepared in the same manner as in Example 2-1.

| | parts by weight |
|---|---|
| [Formulation of Yellow Toner] | |
| Resin B-2 | 100 |
| Yellow Pigment (Trademark "LIONOL FGN-T", made by Toyo Ink Mfg. Co., Ltd.) | 5 |
| TP-203 (Hodogaya Chemical Co., Ltd.) | 2 |
| [Formulation of Magenta Toner] | |
| Resin B-2 | 100 |
| Red Dye (Trademark "OIL PINK #312", Orient Chemical Industries, Ltd.) | 4 |
| TP-302 | 2 |
| [Formulation of Cyan Toner] | |
| Resin B-2 | 100 |
| Blue Pigment (Trademark "LIONOL BLUE FG-7351", made by Toyo Ink Mfg. Co., Ltd.) | 2 |
| TP-302 | 2 |

Although the red dye used for preparing the magenta toner was an amine type, no cross-linking reaction was taken place while kneading the components of the toner.

3.5 parts by weight of the above-prepared each toner and 96.5 parts by weight of a sllicone-coated carrier prepared by coating iron powder trademark "TEFV 23", made by Nihon Teppun Co., Ltd.) with a silicone resin were admixed to prepare two-component type developers of each color.

An amount of electric charges on the above-prepared each developes was measured by a blow-off method, and it was found that the yellow developer, the magenta developer and the cyan developer were charged in an amount of +14.1 μC/g, +12.8 μC/g and +13.3 μC/g, respectively.

An image-forming test was carried out by using these developers in the same manner as in Example 2-1. Images produced by single-color development, two-color-superimposing development and three-color-superimposing development were all clear, and each had a mean glossiness of 23%. In the above test, the lowest limit of image-fixing temperature was 110° C., and a hot off-set phenomenon occurred at 180° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable electric charges were obtained in the course of the above test.

EXAMPLE 2-6

By using Resin C-2 prepared in Synthesis Example 3, yellow, magenta and cyan toners each having the following formulations were prepared in the same manner as in Example 2-1.

| | parts by weight |
|---|---|
| [Formulation of Yellow Toner] | |
| Resin C-2 | 90 |
| Polyester Resin | 10 |
| Yellow Pigment (Trademark "LIONOL YELLOW FGN-T", made by Toyo Ink Mfg. Co., Ltd.) | 5 |
| TP-302 (Hodogaya Chemical Co., Ltd.) | 2 |
| [Formulation of Magenta Toner] | |
| Resin C-2 | 90 |
| Polyester Resin | 10 |
| Red Dye (Trademark "OIL PINK #312", made by Orient Chemical Industries, Ltd.) | 4 |
| TP-302 | 2 |
| [Formulation of Cyan Toner] | |
| Resin C-2 | 90 |
| Polyester Resin | 10 |
| Blue Pigment (Trademark "LIONOL BLUE FG-7351", made by Toyo Ink Mfg. Co., Ltd.) | 2 |
| TP-302 | 2 |

Although the red dye used for preparing the magenta toner was an amine type, no cross-linking reaction was taken place while kneading the components of the toner.

3.5 parts by weight of the above-prepared each toner and 96.5 parts by weight of a silicone-coated carrier prepared by coating iron powder (trademark "TEFV 23", made by Nihon Peppun Co., Ltd.) with silicone resin were admixed to prepare two-component type developers of each color.

An amount of electric charges on the above-prepared each developer was measured by a blow-off method, and it was found that the yellow developer, the magenta developer and the cyan developer were charged in an amount of $+13.9\ \mu C/g$, $+12.2\ \mu C/g$ and $+12.8\ \mu C/g$, respectively.

An image-forming test was carried out by using these developers in the same manner as in Example 2-1. Images produced by single-color development, two-color-superimposing development and three-color-superimposing development were all clear, and each had a mean glossiness of 23%. In the above test, the lowest limit of image-fixing temperature was 110° C., and a hot off-set phenomenon occurred at 190° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable charges were produced in the course of the above test.

EXAMPLE 2-7

By using Resin D-2 prepared in Synthesis Example 4, yellow, magenta and cyan toners each having the following formulations were prepared in the same manner as in Example 2-1.

| | parts by weight |
|---|---|
| [Formulation of Yellow Toner] | |
| Resin D-2 | 90 |
| Polyester Resin | 10 |
| Yellow Pigment (Trademark "LIONOL YELLOW FGN-T", made by Toyo Ink Mfg. Co., Ltd.) | 5 |
| [Formulation of Magenta Toner] | |
| Resin D-2 | 90 |
| Polyester Resin | 10 |
| Red Dye (Trademark "OIL PINK #312", made by Orient Chemical Industries, Ltd.) | 4 |
| [Formulation of Cyan Toner] | |
| Resin D-2 | 90 |
| Polyester Resin | 10 |
| Blue Pigment (Trademark "LIONOL BLUE FG-7351", made by Toyo Ink Mfg. Co., Ltd.) | 2 |

Although the red dye used for preparing the magenta toner was an amine type, no cross-linking reaction was taken place while kneading the components of the toner.

3.5 parts by weight of the above-prepared each toner and 96.5 parts by weight of a carrier of iron powder (trademark "TEFV 23", made by Nihon Teppun Co., Ltd.) were admixed to prepare two-component type developers of each color.

An amount of electric charges on the above-prepared each developer was measured by a blow-off method, and it was found that the yellow developer, the magenta developer and the cyan developer were charged in an amount of $+16.9\ \mu C/g$, $+14.8\ \mu C/g$ and $+15.2\ \mu C/g$, respectively.

An image-forming test was carried out by using these developers in the same manner as in Example 2-1. Images produced by single-color development, two-color-superimposing development and three-color-superimposing development were all clear, and each had a mean glossiness of 23%. In the above test, the lowest limit of image-fixing temperature was 110° C., and a hot off-set phenomenon occurred at 190° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable electric charges were produced in the course of the above test.

EXAMPLE 2-8

By using Resin E-2 prepared in Synthesis Example 5, yellow, magenta and cyan toners were each prepared in the same manner as in Example 2-1. The formulations of the toners are the same as those of the toners in Example 2-2.

Although the red dye used for preparing the magenta toner was an amine type, no cross-linking reaction was taken place while kneading the components of the toner.

3.5 parts by weight of the above-prepared each toner and 96.5 parts by weight of a carrier of iron powder (trademark "TEFV 23", made by Nihon Teppun Co., Ltd.) were admixed to prepare two-component type developers of each color.

An amount of electric charges on the above-prepared each developer was measured by a blow-off method, and it was found that the yellow developer, the magenta developer and the cyan developer were charged in an amount of +18.6 μC/g, +15.9 μC/g and +16.3 μC/g, respectively.

An image-forming test was carried out by using these developers in the same manner as in Example 2-1. Images produced by single-color development, two-color-superimposing development and three-color-superimposing development were all clear, and each had a mean glossiness of 23%. In the above test, the lowest limit of image-fixing temperature was 110° C., and a hot off-set phenomenon occurred at 180° C.

When full-page images were produced on copying paper by three-color-superimposing development, curl of the copying paper, especially at the corner of the paper, was not observed.

Images projected by an OHP was clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable charges were produced in the course of the above test.

EXAMPLE 2-9

By using Resin F-2 prepared in Synthesis Example 6, yellow, magenta and cyan toners each having the following formulations were prepared in the same manner as in Example 2-1.

| | parts by weight |
|---|---|
| [Formulation of Yellow Toner] | |
| Resin F-2 | 90 |
| Epoxy Resin | 10 |
| Yellow Pigment | 5 |
| (Trademark "LIONEL YELLOW FGN-T", made by Toyo Ink Mfg. Co., Ltd.) | |
| [Formulation of Magenta Toner] | |
| Resin F-2 | 90 |
| Epoxy Resin | 10 |
| Red Dye | 4 |

-continued

| | parts by weight |
|---|---|
| (Trademark "LIONOGEN MAGENTA R", made by Toyo Ink Mfg. Co., Ltd.) | |
| [Formulation of Cyan Toner] | |
| Resin F-2 | 90 |
| Epoxy Resin | 10 |
| Blue Pigment | 2 |
| (Trademark "LIONOL BLUE FG-7351", made by Toyo Ink Mfg. Co., Ltd.) | |

3.5 parts by weight of the above-prepared each toner and 96.5 parts by weight of a carrier of iron powder (trademark "TEFV 23", made by Nihon Teppun Co., Ltd.) were admixed to prepare two-component type developers of each color.

An amount electric charges on the above-prepared each developer was measured by a blow-off method, and it was found that the yellow developer, the magenta developer and the cyan developer were charged in an amount of +17.6 μC/g, +14.8 μC/g and +15.9 μC/g, respectively.

An image-forming test was carried out by using these developers in the same manner as in Example 2-1. Images produced by single-color development, two-color-superimposing development and three-color-superimposing development were all clear, and each had a mean glossiness of 23%. In the above test, the lowest limit of image-fixing temperature was 110° C., and a hot off-set phenomenon occurred at 185° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable charges were produced in the course of the above test.

EXAMPLE 2-10

By using Resin G-2 prepared in Synthesis Example 7, yellow, magenta and cyan toners each having the following formulations were prepared in the same manner as in Example 2-1.

| | parts by weight |
|---|---|
| [Formulation of Yellow Toner] | |
| Resin G-2 | 90 |
| Epoxy Resin | 10 |
| Yellow Pigment | 5 |
| (Trademark "LIONOL YELLOW FGN-T", made of Toyo Ink Mfg. Co., Ltd.) | |
| BONTRON P-51 | 1 |
| (Orient Chemical Industries, Ltd.) | |
| [Formulation of Magenta Toner] | |
| Resin G-2 | 90 |
| Epoxy Resin | 10 |
| Red Dye | 4 |
| (Trademark "LIONOGEN MAGENTA R", made by Toyo Ink Mfg. Co., Ltd.) | |
| P-51 | 1 |
| [Formulation of Cyan Toner] | |
| Resin G-2 | 90 |
| Epoxy Resin | 10 |
| Blue Pigment | 2 |

-continued

| | parts by weight |
|---|---|
| (Trademark "LIONOL BLUE FG-7351", made by Toyo Ink Mfg. Co., Ltd.) P-51 | 1 |

3.5 parts by weight of the above-prepared each toner and 96.5 parts by weight of a carrier of iron powder (trademark "TEFV 23", made by Nihon Teppun Co., Ltd.) were admixed to prepare two-component type developers of each color.

An amount of electric charges on the above-prepared each developer was measured by a blow-off method, and it was found that the yellow developer, the magenta developer and the cyan developer were charged in an amount of +18.5 μC/g, +15.6 μC/g and +16.9 μC/g, respectively.

An image-forming test was carried out by using these developers in the same manner as in Example 2-1. Images produced by single-color development, two-color-superimposing development and three-color-superimposing development were all clear, and each had a mean glossiness of 23%. In the above test, the lowest limit of image-fixing temperature was 110° C., and a hot off-set phenomenon occurred at 185° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable charges were produced in the course of the above test.

EXAMPLE 2-11

By using Resin H-2 prepared in Synthesis Example 8, yellow, magenta and cyan toners were each prepared in the same manner as in Example 2-1. Formulations of each toner were the same as those of the toners in Example 2-4.

Although the red dye used for preparing the magenta toner was an amine type, no cross-linking reaction was taken place while kneading the components of the toner.

3.5 parts by weight of the above-prepared each toner and 96.5 parts by weight of a silicone-coated carrier prepared by coating iron powder (Trademark "TEFV 23", made by Nihon Teppun Co., Ltd.) with silicone resin were admixed to prepare two-component type developers of each color.

An amount of electric charges on the above-prepared each developer was measured by a blow-off method, and it was found that the yellow developer, the magenta developer and the cyan developer were charged in an amount of +17.6 μC/g, +14.8 μC/g and +15.5 μC/g, respectively.

An image-forming test was carried out by using these developers in the same manner as in Example 2-1. Images produced by single-color development, two-color-superimposing development and three-color-superimposing development were all clear, and each had a mean glossiness of 23%. In the above test, the lowest limit of image-fixing temperature was 110° C., and a hot off-set phenomenon occurred at 180° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable charges were produced in the course of the above test.

EXAMPLE 2-12

By using Resin I-2 prepared in Synthesis Example 9, yellow, magenta and cyan toners were each prepared in the same manner as in Example 2-1. Formulations of each toner were the same as those of the toners in Example 2-4.

Although the red dye used for preparing the magenta toner was an amine type, no cross-linking reaction was taken place while kneading the components of the toner.

3.5 parts by weight of the above-prepared each toner and 96.5 parts by weight of a silicone-coated carrier prepared by coating iron powder (trademark "TEFV 23", made by Nihon Teppun Co., Ltd.) with silicone resin were admixed to prepare two-component type developers of each color.

An amount of electric charges on the above-prepared each developer was measured by a blow-off method, and it was found that the yellow developer, the magenta developer and the cyan developer were charged in an amount of +17.7 μC/g, +15.9 μC/g and +16.2 μC/g, respectively.

An image-forming test was carried out by using these developers in the same manner as in Example 2-1. Images produced by single-color development, two-color-superimposing development and three-color-superimposing development were all clear, and each had a mean glossiness of 23%. In the above test, the lowest limit of image-fixing temperature was 105° C., and a hot off-set phenomenon occurred at 170° C.

When full-page images were produced on copying paper by three-color-superimposing development, curl of the copying paper, especially at the corner of the paper, was not observed.

Images projected by an OHP were clear and transparent, and no transference of the toner to a vinylchloride sheet was observed.

Clear, sharp images without deposition of the toner on the background were produced even under the conditions of high temperatures and humidities.

Full-color images were continuously produced on 50000 sheets of copying paper. Clear images with stable charges were produced in the course of the above test.

By using Resin I-2, black toner having the following formulation was prepared in the above-mentioned manner.

| [Formulation of Black Toner] | parts by weight |
|---|---|
| Resin I-2 | 90 |
| Styrene-Acrylic Acid Copolymer | 10 |
| Carbon Black #44 | 12 |

-continued

| [Formulation of Black Toner] | parts by weight |
|---|---|
| (Mitsubishi Carbon Co., Ltd.) | |
| Nigrosine Base EX | 1 |
| (Orient Chemical Industries Ltd.) | |

A developer was prepared using the black toner in the above-described manner. A charge amount of the developer was +18.5 μC/g.

An image-forming test was carried out by using the developer and a commercially available electrophographic copying machine (trademark "FT 4820", made by Ricoh Company, Ltd.). As a result, clear images having a mean glossiness of 23% were produced. In the above test, the lowest limit of image-fixing temperature was 105° C., and a hot off-set phenomenon occurred at 170° C.

Clear, sharp images were produced even under the conditions of high temperatures and humidities, and no transference of the toner to a vinylchloride sheet was observed.

Images were continuously produced on 50000 sheets of copying paper by using the developer. Clear images with stable charges were produced in the course of the above test.

Comparative Example 2-1

By simply using an epoxy resin of a bisphenol A type (trademark "EPOMIC R368", made by Mitsui Petrochemical Industries, Ltd.) as a starting material, yellow, magenta and cyan toners were prepared in the same manner as in Example 2-1.

In the course of preparing magenta toner, the components of the toner were cross-linked while kneading, and the mixture was solidified in a thermal-roll mill. Thus the desired magenta toner could not be prepared.

By using the above-prepared yellow and cyan toners, developers were each prepared in the same manner as in Example 2-1. The yellow developer and the cyan developer were charged in an amount of +10.5 μC/g and +8.5 μC/g, respectively These developers were subjected to an image-forming test. Images produced by single-color development and two-color-superimposing development each had a mean glossiness of only 7%, and deposition of the toner on the background was observed.

When full-page images were produced on copying paper by two-color-superimposing development, the copying paper was cylidrically curled.

Unclear images with deposition of the toner on the background were produced under the conditions of high temperatures and humidities.

Images were continuously produced on copying paper by two-color-superimposing development. Unclear images with a considerable amount of toner deposition on the background were produced after producing images on about 1000 sheets of copying paper. On the 1600th sheets, no images were produced. A charge amount of each developer was measured at this moment, and it was found that both developers were charged in negative.

With respect to images produced on copying paper at the initial stage of the above test, no transference of the toner to a vinylchloride sheet was observed.

COMPARATIVE EXAMPLE 2-1

250 g of an epoxy resin of a bisphenol A type (trademark "EPOMIC R368"), 124 g of bisphenol A and 50 ml of xylene were placed in a separable flask equipped with an agitator, a thermometer, a nitrogen gas-introducing tube and a condenser, and the mixture was heated to 70° C. in an atmosphere of nitrogen. An aqueous 0.65N sodium hydroxide solution was added to the mixture, and the mixture was heated to 185° C. While heating, water and the xylene were removed from the mixture under reduced pressure. The mixture was stirred for reaction for 5 hours at atmospheric pressure, followed by addition of 19.6 g of ε-caprolactone and stirring of an additional 6 hour, whereby an esterified epoxy resin having a softening point of 140° C. was prepared.

By using this resin, yellow, magenta and cyan toners were each prepared in the same manner as in Example 2-1. In the course of preparing magenta toner, the components of the toner were cross-linked while kneading, and the mixture was solidified in a thermal roll-mill. Thus the desired magenta toner could not be obtained, and only yellow and cyan toners were successfully prepared.

Developers were each prepared by using the yellow and cyan toners in the same manner as in Example 2-1, and subjected to a single-color image-forming test. As a result, clear single-color images having a mean glossiness of 23% were obtained. In the above test, the lowest limit of image-fixing temperature was 110° C., and a hot off-set phenomenon occurred at 185° C.

When full-page images were produced on copying paper by two-color-superimposing development, curl of the copying paper, especially at the corner of the paper, was not observed.

However, under the conditions of high temperatures and humidities, unclear images with deposition of the toner on the background were produced.

Images were continuously produced on copying paper by two-color-superimposing development. Unclear images with a considerable amount of toner deposition on the background were produced after producing images on about 1000 sheets of copying paper. On the 1600th sheet, no images were produced. A charge amount was measured at this moment, and it was found that developers of both colors were charged in negative.

With respect to images produced on copying paper at the initial stage of the above test, no transference of the toner to a vinylchloride sheet was observed.

COMPARATIVE EXAMPLE 2-3

250 g of an epoxy resin of a bisphenol type (trademark "EPOMIC R368"), 139 g of bisphenol A, 30 g of p-cumylphenol and 50 ml of xylene were placed in a separable flask equipped with an agitator, a thermometer, a nitrogen gas-introducing tube and a condenser, and the mixture was heated to 70° C. in an atmosphere of nitrogen. An aqueous 1.8 N lithium chloride solution was added to the mixture, followed by elevation of the temperature to 185° C. While heating, water and the xylene were removed from the mixture under reduced pressure. The mixture was stirred for reaction for further 5 hours at atmospheric pressure, whereby a polyol resin having a softening point of 142° C.

By using the above-prepared resin, yellow, magenta and cyan toners were each prepared in the same manner as in Example 2-1. In the course of the preparation, no cross-linking reaction was taken place, and desired toners of each color were prepared.

Developers of three colors were each prepared by using the above toners. The yellow developer, the magenta developer and the cyan developer were charged in an amount of +11.0 μC/g, +7.2 μC/g and +9.0 μC/g, respectively.

An image-forming test was carried out by using these developers. Images produced by single-color development, two-color-superimposing development and three-color-superimposing development were all poor in quality, and each had a mean glossiness of only 7%.

When full-page images were produced on copying paper by three-color-superimposing development, the copying paper was cylidrically curled.

Images produced under the conditions of high temperatures and humidities were clear enough, but the background was deposited with the toner.

Full-color images were continuously produced on copying paper. Unclear images with a considerable amount of toner deposition were produced after producing images on about 1000 sheets of copying paper. On the 1600th sheet, no images were produced. An electric charge on each developer was measured at that moment, and it was found that three developers were electrically charged in negative.

With respect to images produced on copying paper, no transference of the toner to a vinylchloride sheet was observed.

COMPARATIVE EXAMPLE 2-4

250 g of an epoxy resin of a bisphenol A type (trademark "EPOMIC R368"), 117 g of bisphenol A and 50 ml of xylene were placed in a separable flask equipped with an agitator, a thermometer, a nitrogen gas-introducing tube and a condenser, and the mixture was heated in an atmosphere of nitrogen. 1 ml of an aqueous 0.65N sodium hydroxide solution was added to the mixture, and the mixture was heated to 150° C. While heating, the xylene was removed from the mixture under reduced pressure. 11 g of stearyl amine was added to the mixture at atmospheric pressure, and the mixture was stirred for reaction for 5 hours at 185° C., whereby an amine-modified epoxy resin having a softening point of 142° C. was prepared.

By using the above-prepared resin, yellow, magenta and cyan toners each having the same formulations as in Example 2-1 were prepared.

In the course of preparing magenta toner, cross-linking reaction was taken place while kneading the components of the toner, and the mixture was solidified in a thermal-roll mill. Thus the desired magenta toner could not be prepared.

Developers were each prepared by using the above-prepared yellow and cyan toners. A charge amount of the yellow developer and the cyan developer were +17.6 μC/g and +15.2 μC/g, respectively.

An image-forming test was carried out by using these developers. All images produced by single-color development and two-color-superimposing development had a mean glossiness of only 7%.

When full-page images were produced on copying paper by two-color-superimposing development, the copying paper was cylindrically curled.

Unclear images with deposition of the toner on the background were produced under the conditions of high temperatures and humidities.

Images were continuously produced on 50000 sheets of copying paper by two-color-superimposing development. As a result, images produced even on the 50000th sheet were clear and sharp, and no depositon of the toner on the background was observed. A charge amount of developers of yellow and cyan on the 50000th sheet was +15.8 μC/g and +13.9 μC/g, respectively.

Images projected by an OHP were clear and transparent, and no transference of the toner to a vinylchloride sheet was observed.

The effects obtained in the above Examples and Comparative Examples are summarized in the table below.

| | Glossiness of Toner Images & Curling of Copied Sheets | Reaction Stability with Amines | Environmental Stability to High Temp. & High Humidity | Positive Charging Durability |
|---|---|---|---|---|
| Example 1 | ○ | ○ | ○ | ○ |
| Example 2 | ○ | ○ | ○ | ○ |
| Example 3 | ○ | ○ | ○ | ○ |
| Example 4 | ○ | ○ | ○ | ○ |
| Example 5 | ○ | ○ | ○ | ○ |
| Example 6 | ○ | ○ | ○ | ○ |
| Example 7 | ○ | ○ | ○ | ○ |
| Example 8 | ○ | ○ | ○ | ○ |
| Example 9 | ○ | ○ | ○ | ○ |
| Example 10 | ○ | ○ | ○ | ○ |
| Example 11 | ○ | ○ | ○ | ○ |
| Example 12 | ○ | ○ | ○ | ○ |
| Comparative Example 1 | X | X | X | X |
| Comparative Example 2 | ○ | X | X | X |
| Comparative Example 3 | X | ○ | ○ | X |
| Comparative Example 4 | X | X | ○ | X |

○: Good
X: No Good

What is claimed:

1. A dry type toner for electrophotography comprising as the main components:

a coloring agent; and a binder agent consisting of a polyol resin in an effective amount, said polyol resin being prepared by subjecting a bisphenol-type epoxy resin containing epoxy groups, which may contain secondary hydroxyl groups, to reaction steps (1), (2) and (3), or steps (2) and (3), in any sequential combination, until substantially no epoxy groups remain in said polyol resin, wherein said reaction step (1) comprises a step of causing said epoxy groups in said bisphenol-type epoxy resin to react with a primary amine; said reaction step (2) comprises a step of causing said epoxy groups to react with a monophenol capable of reacting with said epoxy groups; and said reaction step (3) comprises a step of esterifying said secondary hydroxyl groups or secondary hydroxyl groups produced in said bisphenol-type epoxy resin by reaction step (1) and/or reaction step (2) by use of an esterifying agent with an esterification rate ranging from 0.5 to 30 wt%.

2. The dry type toner for electrophotography as claimed in claim 1, wherein said bisphenol-type epoxy resin is a polycondensated compound between a bisphenol compound and epichlorohydrin.

3. The dry type toner for electrophotography as claimed in claim 2, wherein said bisphenol compound is selected from the group consisting of 2,2-bis(4-hydroxyphenyl)propane, bis(4-hydroxyphenyl)methane, and 1,1-bis(4-hydroxyphenyl)ethane.

4. The dry type toner for electrophotography as claimed in claim 1, wherein said bisphenol-type epoxy resin is a resin having formula (I):

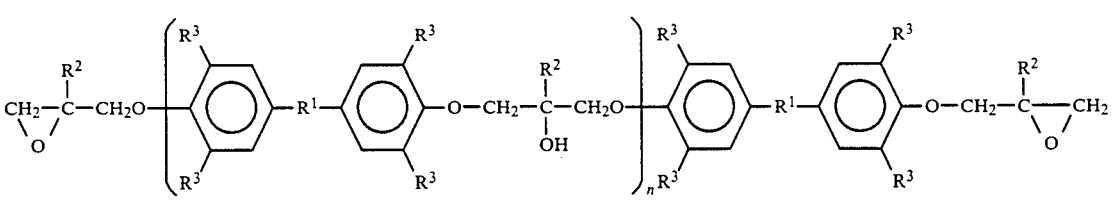

(I)

wherein $R^1$ is

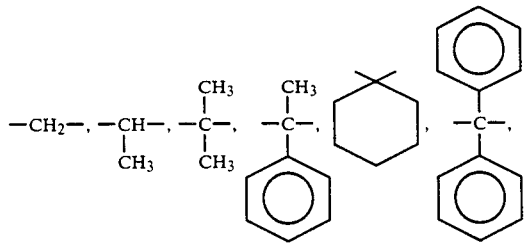

$-SO_2-$ or $-O-$;

$R^2$ is hydrogen or a methyl group;

$R^3$ is hydrogen or a halogen; and n is a number of repetition units, which may be zero.

5. The dry type toner for electrophotography as claimed in claim 1, wherein said primary amine is a primary aliphatic amine having 6 to 20 carbon atoms.

6. The dry type toner for electrophotography as claimed in claim 1, wherein said primary amine is a primary aromatic amine selected from the group consisting of aniline, toluidine, xylidine, cumidine, hexylaniline, nolylaniline and dodecylaniline.

7. The dry type toner for electrophotography as claimed in claim 1, wherein said primary amine is an alicyclic amine having 6 to 20 carbon atoms.

8. The dry type toner for electrophotography as claimed in claim 1, wherein said primary amine is an aliphatic amine having aromatic substituents, having 7 to 15 carbon atoms.

9. The dry type toner for electrophotography as claimed in claim 1, wherein said compound containing an active hydrogen is a secondary amine having 6 to 40 carbon atoms.

10. The dry type toner for electrophotography as claimed in claim 1, wherein said compound containing an active hydrogen is a monophenol having 6 to 40 carbon atoms.

11. The dry type toner for electrophotography as claimed in claim 1, wherein said compound containing an active hydrogen is a monocarboxylic acid having 6 to 25 carbon atoms.

12. The dry type toner for electrophotography as claimed in claim 1, wherein said esterifying agent employed in said reaction step (3) is a monocarboxylic acid having 6 to 25 carbon atoms.

13. The dry type toner for electrophotography as claimed in claim 1, wherein said esterifying agent employed in said reaction step (3) is an ester of a monocarboxylic acid having 6 to 25 carbon atoms.

14. The dry type toner for electrophotography as claimed in claim 1, wherein said esterifying agent employed in said reaction step (3) is a lactone selected from the group consisting of: p-propyolactone, δ-valerolactone, ε-caprolactone, β-butylolactone, and γ-valerolactone.

15. The dry type toner for electrophotography as claimed in claim 1, wherein said reaction steps (1), (2) and (3) are caused to proceed in said order.

16. The dry type toner for electrophotography as claimed in claim 1, wherein said reaction steps (1), (2) and (3) are caused to proceed in the order of said reaction step (2), said reaction step (1) and said reaction step (3).

17. The dry type toner for electrophotography as claimed in claim 1, wherein said reaction steps (1), (2) and (3) are caused to proceed in the order of said reaction steps (1) and (2) simultaneously, followed by said reaction step (3).

* * * * *

UNITED STATES PATENT AND TRADEMARK OFFICE

CERTIFICATE OF CORRECTION

PATENT NO. : 5,061,588

DATED : October 29, 1991

INVENTOR(S) : Hiroyuki FUSHIMI, et al.

It is certified that error appears in the above-identified patent and that said Letters Patent is hereby corrected as shown below:

On title page, item [54], and col. 1, line 1, "DRY TYPE", should read, --DRY-TYPE--.

Column 1, line 7, "dry type", should read, --dry-type--.

Column 1, line 65, "rubber o with", should read, --rubber or with--.

Column 2, line 45, "with ɵ-caprolactone. This", should read, --with ε-caprolactone. This--.

Column 3, line 25, "provide a dry type", should read, --provide a dry-type--.

Column 3, line 28, "dry type", should read, --dry-type--.

Column 3, line 34, "a dry type", should read, --a dry-type--.

Column 3, line 37, "dry type", should read, --dry-type--.

UNITED STATES PATENT AND TRADEMARK OFFICE

CERTIFICATE OF CORRECTION

PATENT NO. : 5,061,588
DATED : October 29, 1991
INVENTOR(S) : Hiroyuki FUSHIMI, et al.

It is certified that error appears in the above-identified patent and that said Letters Patent is hereby corrected as shown below:

Column 3 line 40, "dry type", should read, --dry-type--.

Column 3 line 45, "dry type", should read, --dry-type--.

Column 3, line 50, "dry type", should read, --dry-type--.

Column 4, line 5, "bisphenol type", should read, --bisphenol-type--.

Column 4, line 52, "and EPOMIC R140P made", should read, --and EPOMIC R140P (made--.

Column 4, line 58, "bisphenol type", should read, --bisphenol-type--.

Column 4, line 66, "bisphenol type", should read, --bisphenol-type--.

Column 5, line 46, "bisphenol type", should read, --bisphenol-type--.

UNITED STATES PATENT AND TRADEMARK OFFICE

CERTIFICATE OF CORRECTION

PATENT NO. : 5,061,588

DATED : October 29, 1991

INVENTOR(S) : Hiroyuki FUSHIMI, et al.

It is certified that error appears in the above-identified patent and that said Letters Patent is hereby corrected as shown below:

Column 5, line 47, "bisphenol type", should read, --bisphenol-type--.

Column 5, line 49, "bisphenol type", should read, --bisphenol-type--.

Column 6, line 4, "can be use", should read, --can be used--.

Column 6, line 7, "bisphenol type", should read, --bisphenol-type--.

Column 6, line 21, "bisphenol type", should read, --bisphenol-type--.

Column 6. line 24, "bisphenol type", should read, --bisphenol-type--.

Column 6, line 29, "hydrogencontaining", should read, --hydrogen-containing--.

Column 6, line 39, "bisphenol type", should read, --bisphenol-type--.

UNITED STATES PATENT AND TRADEMARK OFFICE

CERTIFICATE OF CORRECTION

PATENT NO. : 5,061,588

DATED : October 29, 1991

INVENTOR(S) : Hiroyuki FUSHIMI, et al.

It is certified that error appears in the above-identified patent and that said Letters Patent is hereby corrected as shown below:

Column 6, lines 39-40, "bisphenol type", should read, --bisphenol-type--.

Column 6, line 43, "bisphenol type", should read, --bisphenol-type--.

Column 7, line 20, "bisphenol type", should read, --bisphenol-type--.

Column 7, line 37, "bisphenol type", should read, --bisphenol-type--.

Column 8, lines 42-43, "bisphenol type", should read, --bisphenol-type--.

Column 8, line 47, "Steps(1), 20 and (3)", should read, --Steps (1), (2) and (3)--.

Column 9, line 63, "styrene--o-mehtylchloromethacrylate", should read, --styrene -αmethylchloromethacrylate--.

Column 10, line 18, "controlling agent agent can", should read, --controlling agent can--.

UNITED STATES PATENT AND TRADEMARK OFFICE

CERTIFICATE OF CORRECTION

PATENT NO. : 5,061,588

DATED : October 29, 1991

INVENTOR(S) : Hiroyuki FUSHIMI, et al.

It is certified that error appears in the above-identified patent and that said Letters Patent is hereby corrected as shown below:

Column 10, line 31, "fatty acid ex. zinc", should read, --fatty acid (ex. zinc--.

Column 10, line 32, "oxides ex. titanium", should read, --oxides (ex. titanium--.

Column 11, lines 40-41, "iron powder trademark", should read, --iron powder (trademark--.

Column 11, line 60, "hot-off set", should read, -- hot off-set--.

Column 12, line 4, "projector OHP)," should read, --projector (OHP),--.

Column 12, line 29, "trademark", should read, (trademark--.

Column 12, lines 32-33, "hot-off set", should read, --hot off-set--.

Column 12, lines 59-60, "hot-off set", should read, --hot off-set--.

UNITED STATES PATENT AND TRADEMARK OFFICE

CERTIFICATE OF CORRECTION

PATENT NO. : 5,061,588
DATED : October 29, 1991
INVENTOR(S) : Hiroyuki FUSHIMI, et al.

It is certified that error appears in the above-identified patent and that said Letters Patent is hereby corrected as shown below:

Column 13, lines 21-22, "hot-off set", should read, --hot off-set--.

Column 13, line 65, "hot-off set", should read, --hot off-set--.

Column 14, line 27, "hot-off set", should read, --hot off-set--.

Column 19, line 7, "hot-off set", should read, --hot off-set--.

Column 19, line 14, "carried our", should read, --carried out--.

Column 20, line 27, "although", should read, --Although--.

Column 20, lines 57-58, "vinylchloride sheet was not observed.", should read, --vinylchloride sheet was observed.--.

Column 24, line 47, "of a sllicone-coated", should read, --of a silicone-coated--.

UNITED STATES PATENT AND TRADEMARK OFFICE

CERTIFICATE OF CORRECTION

PATENT NO. : 5,061,588

DATED : October 29, 1991

INVENTOR(S) : Hiroyuki FUSHIMI, et al.

It is certified that error appears in the above-identified patent and that said Letters Patent is hereby corrected as shown below:

Column 24, line 48, "powder trademark", should read, --powder (trademark--.

Column 24, line 54, "each developes", should read, --each developer--.

Column 31, line 49, "was cylidrically", should read, --was cylindrically--.

Col. 32, line 63, "of 142C.", should read, --of 142C was obtained.--.

Column 33, line 13, "was cylidrically", should read, --was cylindrically--.

Column 34, line 63, "A dry type", should read, --A dry-type--.

Column 35, line 17, "dry type", should read, --dry-type--.

Column 35, line 21, "dry type", should read, --dry-type--.

UNITED STATES PATENT AND TRADEMARK OFFICE

CERTIFICATE OF CORRECTION

PATENT NO. : 5,061,588

DATED : October 29, 1991

INVENTOR(S) : Hiroyuki FUSHIMI, et al.

It is certified that error appears in the above-identified patent and that said Letters Patent is hereby corrected as shown below:

Column 35, line 26, "dry type", should read, --dry-type--.

Column 35, line 57, "dry type", should read, --dry-type--.

Column 35, line 61, "dry type", should read, --dry-type--.

Column 36, line 4, "dry type", should read, --dry-type--.

Column 36, line 7, "dry type", should read, --dry-type--.

Column 36, line 11, "dry type", should read, --dry-type--.

Column 36, line 15, "dry type", should read, --dry-type--.

Column 36, line 19, "dry type", should read, --dry-type--.

UNITED STATES PATENT AND TRADEMARK OFFICE

CERTIFICATE OF CORRECTION

PATENT NO. : 5,061,588

DATED : October 29, 1991

INVENTOR(S) : Hiroyuki FUSHIMI, et al.

It is certified that error appears in the above-identified patent and that said Letters Patent is hereby corrected as shown below:

Column 36, line 23, "dry type", should read, --dry-type--.

Column 36, line 27, "dry type", should read, --dry-type--.

Column 36, line 43, "dry type", should read, --dry-type--.

Column 36, line 49, "dry type", should read, --dry-type--.

Column 36, line 52, "dry type", should read, --dry-type--.

UNITED STATES PATENT AND TRADEMARK OFFICE

CERTIFICATE OF CORRECTION

PATENT NO. : 5,061,588

DATED : October 29, 1991

INVENTOR(S) : Hiroyuki FUSHIMI, et al.

It is certified that error appears in the above-identified patent and that said Letters Patent is hereby corrected as shown below:

Column 36, line 57, "dry type", should read, --dry-type--.

In the abstract, line 1, "dry type", should read, --dry-type--.

Signed and Sealed this

Fifth Day of October, 1993

Bruce Lehman

*Attest:*

BRUCE LEHMAN

*Attesting Officer*

*Commissioner of Patents and Trademarks*